US006210504B1

(12) United States Patent
Thompson

(10) Patent No.: US 6,210,504 B1
(45) Date of Patent: Apr. 3, 2001

(54) TERTIARY AMINE AZIDES IN LIQUID OR GEL FUELS IN GAS GENERATOR SYSTEMS

(75) Inventor: Darren M. Thompson, Madison, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/316,223

(22) Filed: May 21, 1999

(51) Int. Cl.[7] ..... C06B 47/00; C06D 5/00

(52) U.S. Cl. ..... 149/1; 149/17; 149/45; 149/74; 149/109.4; 60/211

(58) Field of Search ..... 149/1, 17, 45, 149/74, 109.4; 60/211, 212, 213

(56) References Cited

U.S. PATENT DOCUMENTS

| | | | | |
|---|---|---|---|---|
| 4,012,384 | * | 3/1977 | Nielson | 260/248 |
| 4,499,723 | * | 2/1985 | Frankel et al. | 60/211 |
| 5,133,183 | | 7/1992 | Asaoka et al. | 60/204 |
| 5,152,136 | * | 10/1992 | Chew et al. | 60/251 |
| 5,621,156 | * | 4/1997 | Thompson | 44/266 |
| 6,013,143 | * | 1/2000 | Thompson | 149/1 |

* cited by examiner

*Primary Examiner*—Charles T. Jordan
*Assistant Examiner*—Aileen J. Baker
(74) *Attorney, Agent, or Firm*—Arthur H. Tischer; Freddie M. Bush

(57) ABSTRACT

A liquid gas generator system supplies gas pressure only when it is needed. Hydrazine and hydrazine blends have been considered for liquid gas generators because of their ability to decompose at ambient conditions on an iridium catalyst to form warm (1000° F. to 1500° F.) gases. Hydrazine is undesirable because of its toxicity and high melting point (34° F.). The tertiary amine azides, which are defined hereinabove and below, are non-carcinogenic alternatives to hydrazine in liquid or gel gas generator systems. These tertiary amines azides are non-carcinogenic alternatives for use with a thermal reactor bed where exothermic reaction releases enough heat to sustain decomposition for furnishing gases for gas generator systems employed. A tertiary amine typically has three hydrocarbons moieties attached to the nitrogen atom. The tertiary amine azides of this invention can have no more than seven carbon atoms in the molecules. Further, these tertiary amine azides can contain no more than two azide moieties that are attached at the opposite end of the hydrocarbon portions from the amine nitrogen atom. A special case that still meet these requirements is pyrollidine moiety (five atom cyclic structure wherein each end of a linear four carbon atom structure is attached to a common nitrogen atom), and the common nitrogen atom has as attached ethyl azide moiety. A fuel gel propellant fuel that would be a suitable replacement for MMH must be less toxic and have a competitive density impulse for the same engine operating conditions. Three compounds meeting the specified requirements have been synthesized and their physical and chemical properties are evaluated herein as shown in Table 1. The chemical names for these compounds are dimethylaminoethylazide (DMAZ), pyrollidinylethylazide (PYAZ), and bis(ethyazide)methylamine (BAZ). DMAZ has a density of 0.933 and a heat of formation of 580 (cal/g) as compared with MMH having a density of 0.88 and heat of formation of 276 (cal/g).

7 Claims, 2 Drawing Sheets

TERTIARY AMINE AZIDES IN LIQUID OR GEL FUELS IN GAS GENERATOR SYSTEMS

BACKGROUND OF THE INVENTION

A liquid or gel bipropellant rocket propulsion system consists of gas generators, oxidizer and fuel propellant tanks, plumbing, oxidizer and fuel valves, and an engine. This propulsion unit begins operation when the gas generators have been initiated and the gases from the gas generator pressurize oxidizer and fuel propellant tanks. When the oxidizer and fuel valves open, the pressurized oxidizer and fuel tanks then force the propellants through the plumbing into the engine where the propellants are mixed and ignited. The propellants can be ignited by either ignition aids or by hypergolic chemical reaction. Ignition aids can take up valuable space in the propulsion system so a hypergolic chemical reaction is the preferred ignition method. Inhibited Red Fuming Nitric Acid (IRFNA) type IIIB and monomethyl hydrazine (MMH) ignite when contacted with each other because of a hypergolic chemical reaction and are the preferred oxidizer and fuel for bipropellant rocket propulsion systems. These propellants can deliver a specific impulse of 284 lbf sec/lbm and density impulse of 13.36 lbf sec/cubic inch when the engine operating pressure is 2000 psi. Special precautions must be used when handling because of its toxic properties.

If a liquid gas generator is used excess pressurizing gases do not have to be dumped overboard to prevent overpressurization that can result from a solid gas generator formulation. A solid gas generator formulation once ignited cannot be stopped; however, a liquid gas generator system supplies gas pressure only when it is needed. Hydrazine and hydrazine blends have been considered for liquid gas generators because of their ability to decompose at ambient conditions on an iridium catalyst preheated to above 350° F. to form warm (1000° F. to 1500° F.) gases. Hydrazine is undesirable because of its toxicity and high melting point (34° F.).

An object of this invention is to provide a less toxic liquid/gas generator propellant that is a suitable replacement for hydrazine or hydrazine blends.

Another object of this invention is to provide less toxic fuel gel propellants which are good candidates for gas generators because of their exothermic decomposition.

A further object of this invention is to provide an alternate less toxic fuel gel propellant which decomposes exothermically to release enough heat to sustain decomposition in a thermal reactor bed.

A further object of this invention is to provide gas generators as alternative fuels selected from tertiary amine azides that can function also as hypergolic fuels in a bipropellant propulsion system to meet the above conditions as further described hereinbelow.

SUMMARY OF THE INVENTION

The tertiary amine azides which are defined below are non-carcinogenic alternatives to hydrazine in liquid gas generator systems or monopropellant thruster propulsion systems. The tertiary amine azides which are defined below are non-carcinogenic alternative for use with a thermal reactor bed where exothermic reaction releases enough heat to sustain decomposition for furnishing gases for gas generator systems employed. Calorimetry methods have been used to determine the heat of formation of these compounds since this information has not been published in the open literature. The heat of formation data has been used to determine the specific impulse and density impulse of the respective formulations. A tertiary amine typically has three hydrocarbon moieties attached to the nitrogen atom. The tertiary amine azides of this invention can have no more than seven carbon atoms in the molecules.

Further, these tertiary amine azides can contain no more than two azide moieties which are attached at the opposite end of the hydrocarbon portions from the amine nitrogen atom. A special case that still meet these requirements is a pyrollidine moiety (five atom cyclic structure wherein each end of a linear four carbon atom structure is attached to a common nitrogen atom), and the common nitrogen atom has an attached ethyl azide moiety.

Pyrollidinylethylazide (PYAZ) has the following structure:

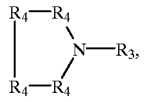

wherein $R_3$ is as previously defined and wherein $R_4$ is $—CH_2$.

Three compounds meeting the specified requirements have been synthesized and their physical and ballistic properties are evaluated herein as shown in Table 1. The chemical names for these compounds are dimethylaminoethylamine (DMAZ), pyrollidinylethylazide (PYAZ), and bis (ethyl azide)methylamine (BAZ). The structural formulae for these compounds are defined hereinbelow.

Dimethylaminoethylamine (DMAZ) has the following structure:

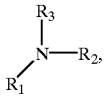

wherein $R_1$=$—CH_3$,
$R_2$=$—CH_3$,
$R_3$=$—CH_2CH_2N$.

Bis(ethylazide)methylamine (BAZ) has the following structure:

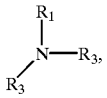

and wherein
$R_1$ and $R_3$ are as previously defined.

DESCRIPTION OF THE PREFERRED EMBODIMENT(S)

Figure 1:
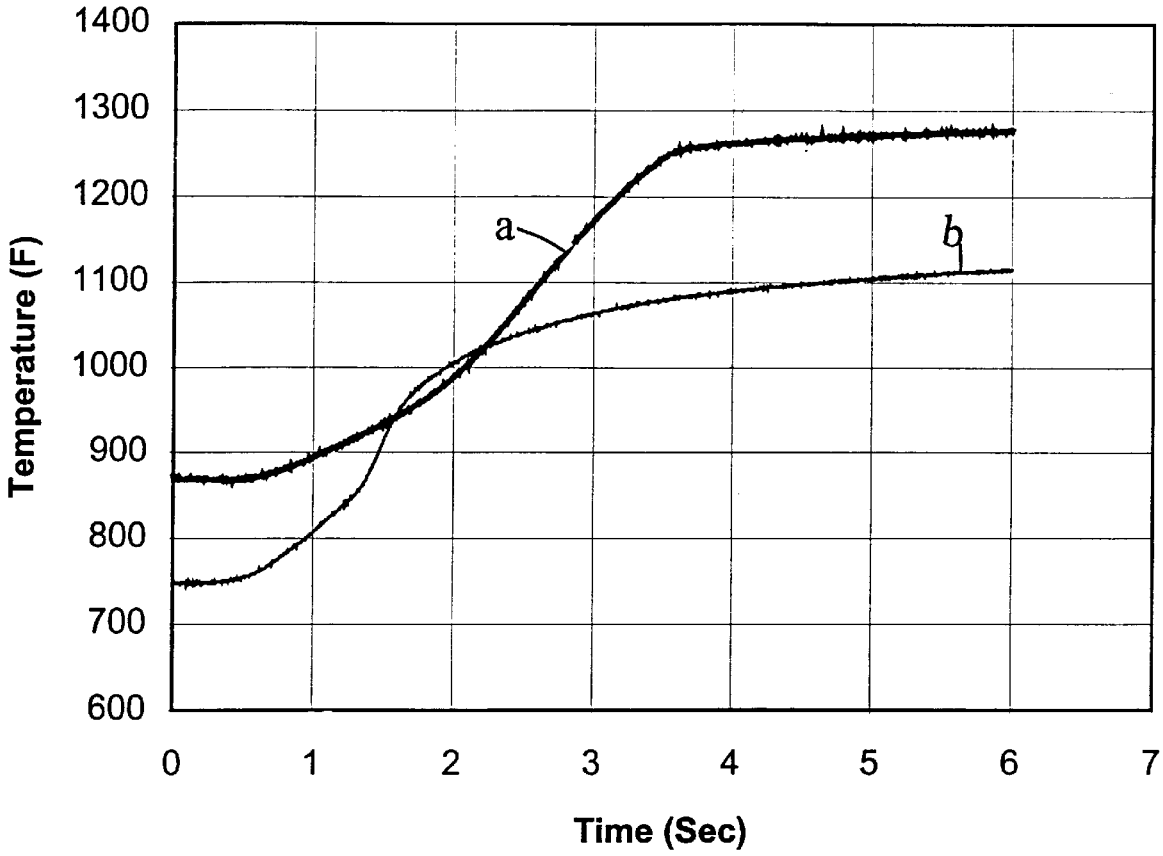
FIG. 1 of the Drawing depicts the temperature of the gas generator reactor during operation using hydrazine and DMAZ, curve a and curve b respectively.
Figure 2:
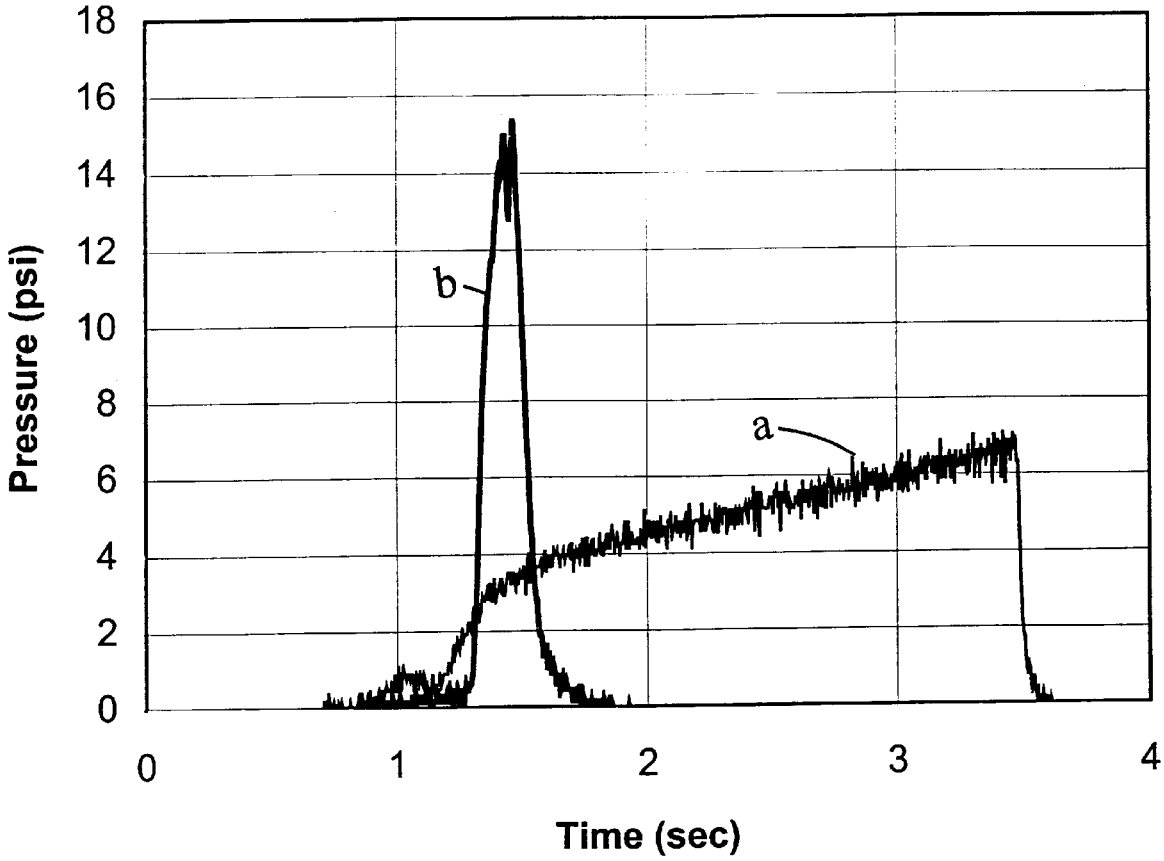
FIG. 2 of the Drawing depicts the pressure of the gas generator reactor during operation using hydrazine and DMAZ, curve a and curve b respectively.

Where there exists bipropellant liquid or gel propulsion systems which use fuel gel as one of the components, (this would include NASA systems which uses nitrogen tetroxide and MMH for reactive control systems, and the Army and Air Force of the components, (this would include NASA systems which uses nitrogen tetroxide and MMH for reactive control systems, and the Army and Air Force systems which use IRFNA and MMH for tactical systems) DMAZ fuel could be used as a no-carcinogenic alternative to MMH. The tertiary amine azide gel can have from 0.5–10% gellant. The gellant can be silicon dioxide, clay, carbon, or any polymeric gellant. The tertiary amine azide gel can also include additives to improve the specific impulse and density impulse. These solid additives can include but would not be limited to amine-nitrate salts, quaternary ammonium salts, or triaminotrinitrobenzene. The formulation can contain 1%–90% solid additive, 98.5%–10% tertiary amine azide and 0.5%–10% gellant.

The tertiary amine azides used as hypergolic liquid or gel fuels in accordance with this invention have the requirement specified in Table 1 which are responsible for their superior fuel characteristics. The inclusion of an azide moiety into the tertiary amine molecule, improves the density and energy content. The effect that the azide moiety had on ignition delay was unexpected. In the propulsion literature tertiary amines typically have a 20–30 millisecond ignition delay while the hydrazines have a 3–10 millisecond ignition delays. The presence of the azide moiety reduces the ignition delay of tertiary amines to the hydrazine levels. Testing of dimethylaminoethylazide (DMAZ) was tested and had a 6 millisecond ignition delay. Calorimetry methods were used to determine the heats of formation of the tertiary amine azides. The freezing points have been verified using DSC (differential scanning calorimetry) method. The boiling points have been determined by observation. The heat of formation data has been used to determine the specific impulse and density specific impulse for each of the tertiary amines.

In existing bipropellant liquid/gel gas generator systems that use hydrazine or hydrazine blends, a tertiary amine azide of this invention is used as a non-carcinogenic alternative to hydrazine or hydrazine blends. In a gel formulation the tertiary amine azide gel can be 0.5%–10% gellant. The gellant can be silicon dioxide, clay, carbon, or any polymeric gellant. The tertiary amine azide gel can also include additives that could improve the specific impulse and density specific impulse. These solid additives could include but is not limited to carbon, aluminum, silicon, boron, tungsten, triaminotrinitrobenzene or tetramethylammoniumazide. The formulation can be 1%–90% solid additive, 98.5%–10% tertiary amine azide and 0.5%–10% gellant.

Table 1 (below) displays the physical and ballistic properties of the tertiary amine azide fuels. PYAZ has a considerably broader boiling point to freezing point range. All of the fuels have large densities.

TABLE 1

| COMPOUND | UNITS | MMH | DMAZ | PYAZ | BAZ |
|---|---|---|---|---|---|
| Boiling Point | (0° F.) | 188 | 276 | d–310 | d–316 |
| Freezing Point | (0° F.) | 63 | −92 | −176 | 61 |
| Density | (g/cc) | 0.88 | 0.933 | 0.986 | 1.06 |
| Heat of Formation | (cal/g) | 276 | 580 | 520 | 828 |

d = Compound decomposes before boiling

The gel can have 0.5%–10% gellant. The gellant can be selected from the group of gellant consisting of silicon dioxide, clay, carbon or any polymeric gellant. The DMAZ gel can also include additives for improving the specific impulse and density impulse. These additives can include but are not be limited to carbon, aluminum, silicon or boron. These additives can be in a formulation comprised of about 1%–70% boron, carbon, silicon or aluminum; 98.5%–20% DMAZ; and 0.5%–10% gellant.

The tertiary amine as hypergolic fuel can be employed with a common pressurization source which can be employed to expel an oxidizer into a combustion chamber as illustrated in commonly assigned U.S. Pat. No. 5,133,183. The described features can be within the spirit and scope of this invention.

It is to be understood, therefore, that while the present invention has been described by means of specific examples, it should not be limited thereto, for obvious variations and modifications may occur to those skilled in the art and such variations and modifications may be adhered to without departing from the spirit of the invention or the scope of the appended claims.

I claim:

1. A tertiary amine azide gas generator fuel source for a liquid or gel gas generator system as defined below:

said liquid or gel fuel generator system comprising:

(i) a tertiary amine azide gas generator fuel source which decomposes exothermically to release sufficient heat to sustain decomposition in a catalytic reactor bed, said tertiary amine azide gas generator fuel source selected from the group of tertiary amine azides consisting of dimethylaminoethylazide, pyrollidinylethylazide, and bis(ethylazide) methylamine; and, (ii) an iridium catalytic reactor bed preheated to above 350° F. to enable said iridium catalytic reactor bed to achieve a self sustaining decomposition reaction of said tertiary amine azide gas generator fuel source when said tertiary amine azide gas generator fuel source is added to said preheated iridium catalytic reactor bed to yield gaseous products under pressure for pressurization of a liquid or gel gas generator system.

2. The liquid or gel fuel system as defined in claim 1 wherein said tertiary amine azide is dimethylaminoethylazide in the form of a gel and having the following structure:

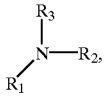

wherein $R_1$=—$CH_3$, $R_2$=—$CH_3$, $R_3$=—$CH_2CH_2N$.

3. The dimethylaminoethylazide gel as defined in claim 2 wherein said gel contains a solid additive selected from the group of solid additives consisting of amine-nitrate salts, quaternary ammonium salts, and triaminotrinitrobenzene, said dimethylaminethylazide gel containing 1%–90% solid additives, 98.5%–10% said tertiary amine azide, and 0.5%–10% gellant selected from silicon dioxide, clay, carbon, and a polymeric gellant.

4. The liquid or gel fuel propulsion system as defined in claim 1 wherein said tertiary amine azide is pyrollidinylethylazide in the form of a gel and having the following structure:

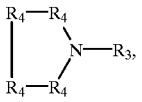

wherein $R_3$ is as
previously defined and wherein $R_4$ is $—CH_2$.

5. The pyrollidinylethylazide gel as defined in claim 4 wherein said gel contains a solid additive selected from the group of solid additives consisting of amine-nitrate salts, quaternary ammonium salts, and triaminotrinitrobenzene, said pyrollidinylethylazide gel containing 1%–90% solid additives, 98.5%–10% said tertiary amine azide, and 0.5%–10% gellant selected from silicon dioxide, clay, carbon, and a polymeric gellant.

6. The liquid or gel fuel propulsion system as defined in claim 1 wherein said tertiary amine azide is bis(ethylazide) methylamine in the form of a gel and having the following structure:

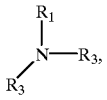

and wherein
$R_1$ and $R_3$ are as previously defined.

7. The bis(ethylazide)methylamine gel as defined in claim 6 wherein said gel contains a solid additive selected from the group of solid additives consisting of amine-nitrate salts, quaternary ammonium salts, and triaminotrinitrobenzene, said bis(ethylazide)methylamine containing 1%–90% solid additives, 98.5%–10% said tertiary amine azide, and 0.5%–10% gellant selected from silicon dioxide, clay, carbon, and a polymeric gellant.

* * * * *